US005330555A

United States Patent [19]

Lorenz

[11] Patent Number: 5,330,555

[45] Date of Patent: Jul. 19, 1994

[54] PROCESS AND APPARATUS FOR MANUFACTURING LOW-GAS AND PORE-FREE ALUMINUM CASTING ALLOYS

[75] Inventor: Heinz Lorenz, Toging/Inn, Fed. Rep. of Germany

[73] Assignee: VAW Aluminium AG, Bonn, Fed. Rep. of Germany

[21] Appl. No.: 46,766

[22] Filed: Apr. 13, 1993

[30] Foreign Application Priority Data

Apr. 18, 1992 [DE] Fed. Rep. of Germany ..... 42121936

[51] Int. Cl.[5] ..... C22B 9/04

[52] U.S. Cl. ..... 75/386; 75/678; 266/91; 266/208

[58] Field of Search ..... 75/386, 678; 266/91, 266/208

[56] References Cited

U.S. PATENT DOCUMENTS

| | | | |
|---|---|---|---|
| 4,049,248 | 9/1977 | Gjosteen et al. | 266/202 |
| 4,258,099 | 3/1981 | Narumiya | 428/311 |
| 4,714,104 | 12/1987 | Ouchi et al. | 266/208 |
| 4,738,717 | 4/1988 | Dokken | 266/91 |

FOREIGN PATENT DOCUMENTS

| | | |
|---|---|---|
| 0174061 | 3/1986 | European Pat. Off. . |
| 0191586 | 8/1986 | European Pat. Off. . |

OTHER PUBLICATIONS

Patent Abstracts of Japan, vol. 8168, Aug. 1984 Re Jap. Pat. No. JP 59 067350 dated Apr. 1984.

*Primary Examiner*—Melvyn J. Andrews
*Attorney, Agent, or Firm*—Perman & Green

[57] ABSTRACT

The invention relates to a process and apparatus for manufacturing low-gas and pore-free aluminum casting alloys by vacuum degasification and densification of the melt. Contact between the aluminum melt and the atmospheric humidity of the alloying process, from refining to continuous casting of the cast bars, is kept extremely short, so that effective vacuum degasification, and a high cooling rate, can prevent the formation of gas pores. After the metal melt is alloyed in a smelting furnace, the melt is fed through a system of gutters directly to at least one vacuum furnace. Refining components are added in the vacuum furnace and heating is conducted to provide the pouring temperature required for continuous casting. The vacuum in the vacuum furnace is maintained to degasify the melt and increase the density thereof, monitored by periodic measurements of the metal density until a stable maximum density is obtained, and the metal melt is then fed through the gutter system directly to the continuous casting mold to produce low gas, substantially pore-free aluminum alloy castings.

15 Claims, 2 Drawing Sheets

PROCESS AND APPARATUS FOR MANUFACTURING LOW-GAS AND PORE-FREE ALUMINUM CASTING ALLOYS

BACKGROUND OF THE INVENTION

1. Field of the Invention

The invention relates to a process and an apparatus for manufacturing low-gas and pore-free aluminum casting alloys. Crucible or tank-type furnaces generally are used to make casting alloys. Either liquid electrolysis metal is loaded or solid metal is smelted. The desired alloy composition is adjusted by adding alloy components such as silicon, magnesium, copper, titanium and/or nickel. The smelting bath is heated to dissolve and alloy the components. Increased amounts of hydrogen are absorbed because aluminum in the liquid state has a high dissolving capacity for hydrogen. The latter is produced by the reaction of liquid aluminum with steam and is immediately absorbed atomically by the melt. The steam comes in contact with the molten aluminum through the materials used, the jackets of the oven and crucible, the tools, the melting auxiliaries and flux, the combustion of gaseous and liquid fuels, and the atmospheric humidity. The amount of hydrogen dissolved depends on the temperature of the metal, the composition of the alloy, and the partial pressure of the hydrogen. The hydrogen uptake is favored by open burner flames or vigorous bath movements in induction furnaces. In the refining of casting alloys with alkali and alkaline earth metals such as strontium, sodium and calcium, the hydrogen content of the melt increases considerably to values of more than 0.3 ml hydrogen per 100 g of metal, since steam decomposes even more rapidly under the influence of these metals. The melt should be purified immediately before pouring if possible, since treatment performed too early can lead to contamination once again during subsequent technological steps, for example pouring to transport the melt. In particular, the melt coming in contact with the humidity in the atmosphere results in an increase in hydrogen content and the resultant undesirable increased porosity of the aluminum castings. Usual purification processes are performed with inert as well as chemically-active gases. During flushing with inert gases (argon or nitrogen, for example), the hydrogen is practically physically removed by lowering its partial pressure. This type of hydrogen removal is expensive from the technical standpoint and poses the risk of hydrogen coming in contact with the melt during treatment. In addition, undesirable nitride formation can occur when nitrogen is used with certain alloy components. When chemically active chlorine gas is employed, aluminum chloride is formed and rises to the surface; it produces effective flushing because of its distribution in the melt. Chlorine gas is a serious environmental poison, however, and is also expensive to manufacture. The protective measures required to prevent the escape of the poisonous gas and its reaction products require considerable investment. In contrast to the use of chemical agents, vacuum degasification of the melt is especially environmentally friendly and effective method. However, this method is not optimally successful, mainly because of the costly transportation of the melt, intermediate cooling and remelting after the necessary alloying, refining, and vacuum degasification processes, until continuous casting takes place and the necessary coming into contact with the atmospheric humidity which that involves, so that the alloying and refining process followed by continuous casting does not produce gas-poor and pore-free aluminum casting alloys.

SUMMARY OF THE INVENTION

The present invention provides a process and an apparatus for manufacturing low-gas and pore-free aluminum casting alloys in which contact between the aluminum melt and the atmospheric humidity of the alloying process is maintained extremely low through refining to continuous casting of the cast bars, so that environmentally-friendly and effective vacuum degassing can be used and the formation of large gas pores prevented by a high cooling rate.

THE DRAWING

DETAILED DESCRIPTION

According to the present invention, alloys of reduced porosity are produced by alloying the metal melt in a smelting furnace, guiding the smelted alloy melt through a system of gutters directly to at least one vacuum furnace wherein refining components are added, and the pouring temperature required for continuous casting is adjusted. The vacuum in each vacuum furnace is maintained for another 5 to 240 minutes, with periodic measurement of the metal density, and at this point the molten metal is fed through the gutter system directly to the continuous casting system, with the molten metal being filtered prior to entering the continuous casting mold. According to the invention, the melt is guided from the smelting furnace through the gutter system alternately or simultaneously into two vacuum furnaces, so that the continuous casting system, preferably a horizontal continuous casting mold, can be fed continuously with melt. For optimum qualitative and quantitative performance of the process, it is important that the density of the metal be measured during holding in the vacuum furnace. This makes it possible to control the residence time of the melt under vacuum conditions. It is advantageous that during the holding of the vacuum, the level of the vacuum remains between 100 and 1 mbar.

Regulation of the duration of the vacuum during the holding period depends primarily on the metal density values measured, since density is a measure of air content or porosity. Thus, it may be necessary to maintain or to vary the vacuum during holding. For example, it is advantageous that the the vacuum be as high as possible during holding, as the density of the metal increases to a stable high value volume approximating the density of pure aluminum, while hydrogen and/or other gases are withdrawn.

By using a water-cooled horizontal continuous casting mold that is loaded quickly, and with relatively short travel for the melt from the vacuum furnace, a high cooling rate is likewise achieved that prevents formation of large pores. The arrangement of the smelting furnace, at least one vacuum smelting furnace, and the continuous casting mold, which are linked directly together by a system of gutters, makes it possible to keep the metal always in the molten state during the treatment process. Energy-intensive hardening and remelting processes are eliminated by optimum transportation of the melt through the gutter system. To facilitate the flow of the melt through the gutter system by gravity, a slope is provided by locating the furnace, the vacuum furnaces and the continuous casting system on different levels and/or by using a height-adjustable gutter system. The gutter system according to the invention is an open system so that the flow of the melt can be observed at any time. Because of the short distance involved, contact of the melt with atmospheric humidity is minimal.

Figure 1:
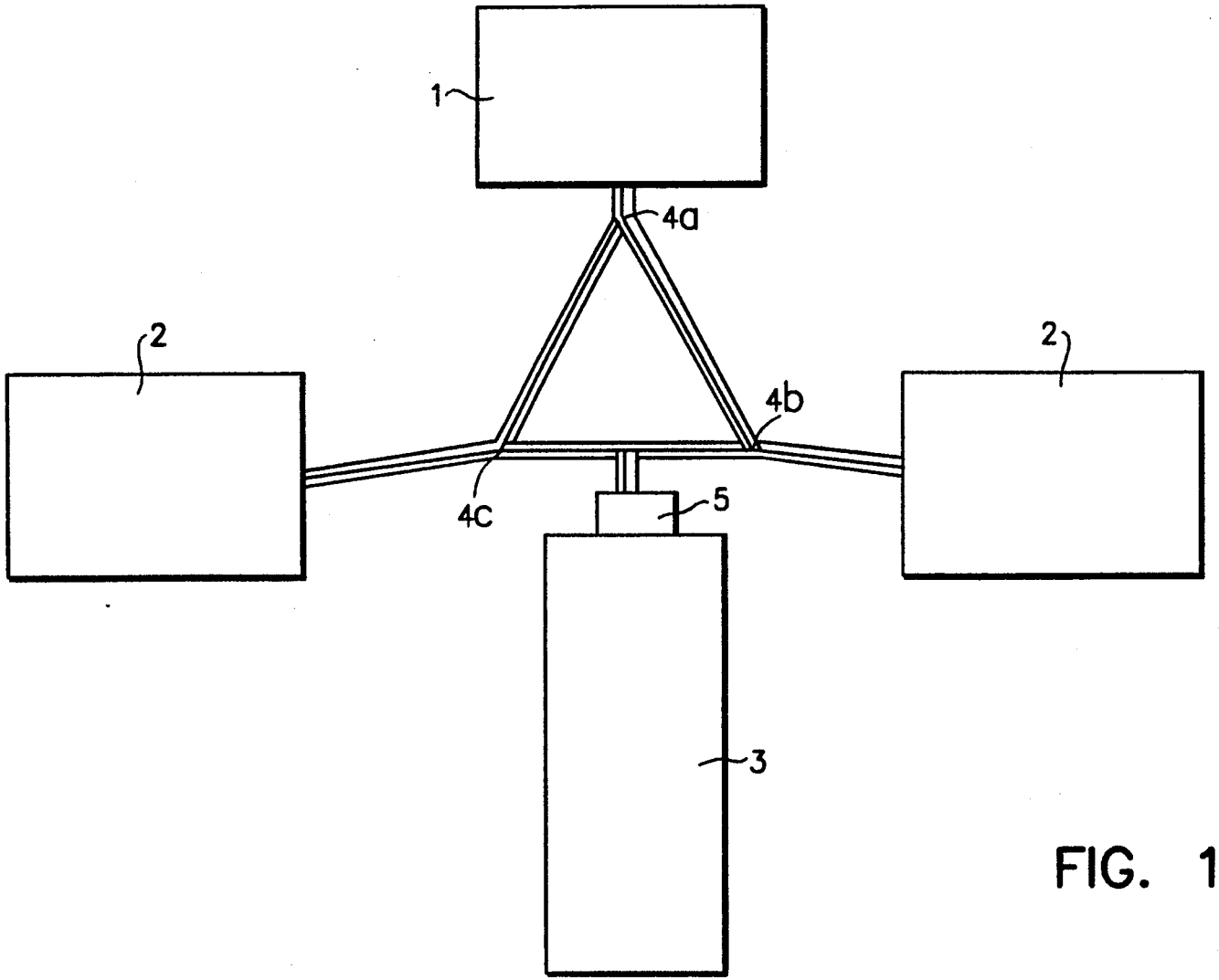
FIG. 1 is a diagrammatic illustration of an apparatus composed of a smelting furnace, two vacuum smelting furnaces, and one horizontal continuous casting system with a ceramic mold filter, all linked by a system of gutters or troughs for the gravity flow of molten alloy.

Referring to the drawing, the smelting furnace 1 in FIG. 1 generally is a crucible or tank-type furnace. It serves to make the alloy. The alloy components such as silicone, magnesium, copper, titanium, nickel, etc. are hatched, and a refining treatment with reactive or inert gas is performed, and the metal temperature required to transfer the melt to vacuum furnace 2 is set. The melt flows downhill from furnace 1 under the influence of gravity through gutter section 4*a* into the two vacuum furnaces 2. The capacity of furnace 1 is so great that both vacuum furnaces 2 can be loaded alternately through gutter sections 4*b* and 4*c*. The refining components such as strontium, sodium, and calcium are alloyed here at the necessary temperature set to reflect the predetermined pouring temperature. In vacuum furnace 2, the alloy melt is subjected to a vacuum treatment controlled in accordance with the results of the metal density test. Following a positive density test, the melt is gravity fed through sections 4*b* and 4*c*, from the two vacuum furnaces 2 sequentially, through the gutter system and through an interposed ceramic mold filter 5, which is at a lower position than connections 4*b* and 4*c*, to water-cooled horizontal continuous casting system 3, and cast to form standard bars. The low-gas, pore-free cast alloys thus produced make it possible with proper remelting to turn out ductile pore-free castings.

The gutter or trough system of FIG. 1 contains multiple connections 4*a*, 4*b* and 4*c*, each of which may be adjustable heightwise to control the direction of gravity flow of the molten metal from the smelting furnace 1 to either or both of the vacuum alloying furnaces 2, and from either or both of the vacuum alloying furnaces 2 to the filter 5 and mold 3. Connections 4*b* and 4*c* can contain movable slide plates or baffles to direct the metal flow from furnace 1 to furnaces 2, and from furnaces 2 to filter 5.

Figure 2:
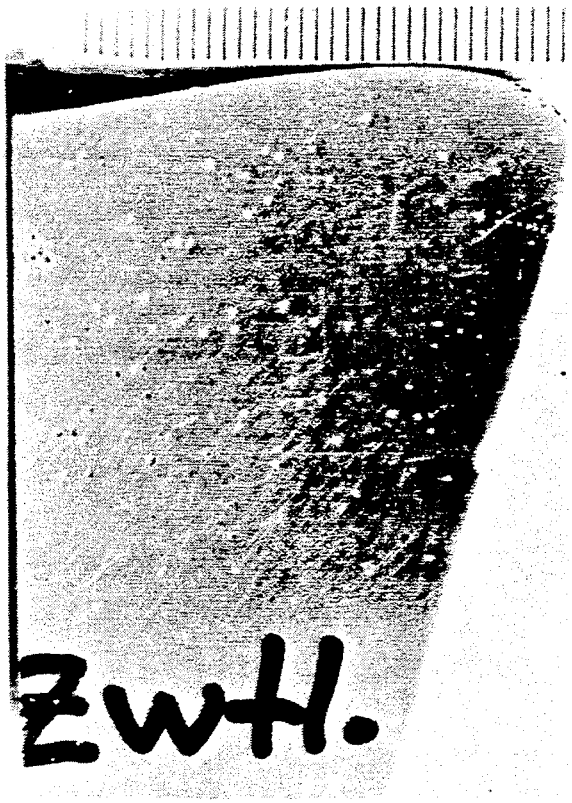
FIG. 2 is a cross section of a pig or casting made of metallurgical alloy poured on a prior known water-cooled pig-casting machine, illustrating the large pore content thereof.
Figure 3:
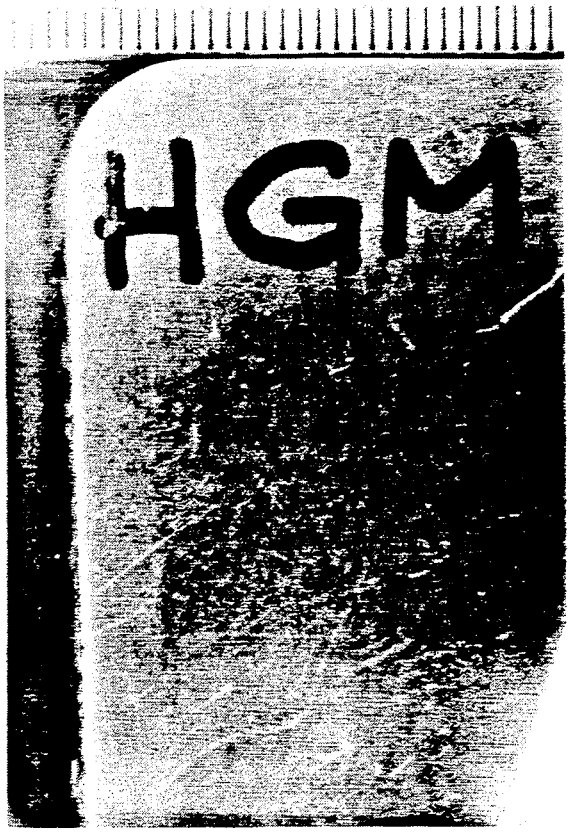
FIG. 3 is a cross section through a continuous-cast bar, cast according to the process of the present invention and using the apparatus of the present invention.

Castings of alloys produced according to the prior art process and casting apparatus contain a high degree of porosity due to a large amount of non-liberated gas, as illustrated by FIG. 2 of the drawing, whereas castings of similar alloys produced by the present process and apparatus are substantially gas-free and non-porous, as illustrated by FIG. 3.

As disclosed hereinbefore, the present process involves monitoring the density of the molten alloy during vacuum degasification and densification. The removal of gases from the molten alloy, under the high vacuum conditions, causes the density to increase to the maximum possible density value for the particular alloy being used, which value is similar to the theoretical density of said alloy or of pure aluminum. As soon as the density measurements stabilize at a maximum value, or satisfy the positive density test, the alloy is substantially gas-free and non-porous and can be discharged from the vacuum furnaces 2 down to the filter 5 and mold 3.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. Process for manufacturing low-gas and substantially pore-free aluminum alloy castings by vacuum treatment of the alloy melt, characterized by the steps of (a) alloying the metal melt in a smelting furnace; (b) feeding the melt to at least one vacuum furnace; (c) heating the melt to a casting temperature required for continuous casting; (d) maintaining a vacuum in the vacuum furnace to degasify the melt and increase the density of the melt to a maximum density; (e) feeding the maximum density melt to a continuous casting mold, and forming low-gas and pore-free aluminum alloy castings therefrom.

2. Process according to claim 1 characterized by the step of filtering the metal melt before it enters the continuous casting mold.

3. Process according to claim 1 characterized by the melt being supplied from the smelting furnace through a gutter system alternately or simultaneously to two vacuum furnaces.

4. Process according to claim 1 characterized by the step of periodically interrupting the vacuum in the vacuum furnace to measure the metal density, until a stable high maximum density measurement is obtained.

5. Process according to claim 1 characterized by the level of the vacuum being between 100 and 1 mbar during the holding of the vacuum.

6. Process according to claim 1 characterized by the fact that the level of the vacuum is kept constant while the vacuum is maintained.

7. Process according to claim 1, characterized by the fact that the level of the vacuum is varied while the vacuum is maintained.

8. Process according to claim 1, characterized by the intensity of the vacuum treatment being correlated to the metal density.

9. Process according to claim 1, characterized by the duration of the vacuum being increased with increasing metal density.

10. Apparatus for producing low-gas, substantially pore-free aluminum casting alloys and for producing low-gas, substantially pore-free aluminum alloy castings therefrom, comprising (a) a smelting furnace for alloying an aluminum alloy; (b) means for conveying the alloy to at least one vacuum smelting furnace; (c) at least one vacuum smelting furnace comprising means for heating the alloy to a continuous casting temperature, means for applying a variable vacuum pressure to said heated alloy to withdraw gas therefrom and increase the density thereof, and means for measuring the density of the heated alloy until a stable maximum density measurement is obtained, representative of a low-gas, substantially pore-free aluminum alloy, and (d) means for conveying said alloy to a continuous casting mold to produce low-gas, substantially pore free aluminum alloy castings therefrom.

11. Apparatus according to claim 10 in which the level of the smelting furnace is above the level of each vacuum smelting furnace and of the continuous casting mold, comprising a gravity-flow gutter means for conveying the alloy to said vacuum smelting furnace(s) and to said mold.

12. Apparatus according to claim 10 characterized by the continuous casting mold being a horizontal casting mold.

13. Apparatus according to claim 11 characterized by the gutter system being open to permit observation of the melted alloy being conveyed.

14. Apparatus according to claim 10 comprising a spaced pair of vacuum smelting furnaces, gravity flow gutter means for conveying molten alloy from said smelting furnace alternately or simultaneously down to said vacuum smelting furnaces, and additional gravity flow gutter means for conveying the vacuum-degasified alloy from said vacuum smelting furnaces down to said mold.

15. Apparatus according to claim 14 in which said mold is associated with a ceramic mold filter for filtering the degasified alloy received from said additional gravity flow gutter means.

* * * * *